US006652187B2

(12) United States Patent
Fowler

(10) Patent No.: US 6,652,187 B2
(45) Date of Patent: Nov. 25, 2003

(54) PORTABLE COFFERDAM AND METHOD FOR STABILIZING THE STRUCTURAL INTEGRITY OF BOX CULVERT BRIDGES

(75) Inventor: Danny Wayne Fowler, Tabor City, NC (US)

(73) Assignee: State of North Carolina

( * ) Notice: Subject to any disclaimer, the term of this patent is extended or adjusted under 35 U.S.C. 154(b) by 0 days.

(21) Appl. No.: 10/074,101

(22) Filed: Feb. 11, 2002

(65) Prior Publication Data

US 2002/0110421 A1 Aug. 15, 2002

Related U.S. Application Data

(60) Provisional application No. 60/269,090, filed on Feb. 15, 2001.

(51) Int. Cl.[7] ..... E02D 23/16

(52) U.S. Cl. ..... 405/13; 405/11; 405/124

(58) Field of Search ..... 405/11, 12, 13, 405/14, 8, 124, 125, 126, 136, 137, 230

(56) References Cited

U.S. PATENT DOCUMENTS 3,857,249 A * 12/1974 Kelly et al. ..... 405/11
4,175,510 A * 11/1979 Devine ..... 114/227
4,362,437 A * 12/1982 Leary ..... 405/188
4,522,532 A * 6/1985 Fedrick ..... 405/11
5,037,604 A * 8/1991 Bauer et al. ..... 376/260
6,330,776 B1 * 12/2001 Jinno et al. ..... 52/649.1

FOREIGN PATENT DOCUMENTS

JP 402043407 A * 2/1990 ..... 405/136
JP 405058386 A * 3/1993 ..... 405/124

* cited by examiner

*Primary Examiner*—Heather Shackelford
*Assistant Examiner*—Lisa M. Saldano
(74) *Attorney, Agent, or Firm*—Fred Lamar

(57) ABSTRACT

A portable cofferdam and method for use in stabilizing the subsurface of box culvert structures. The portable cofferdam is inserted inside the tubular section of large box culverts, which are often used as road crossings over streams, creeks and small rivers. The portable cofferdam is designed as a chamber having an open top end and open bottom end with a floor seal to engage against the box culvert floor. Once inside the culvert, the chamber floor seal is compressed against the culvert floor by an expansion device which extends against the culvert ceiling. Once a proper seal is created against the culvert floor, the chamber is dewatered. With the culvert floor exposed, a hole can be drilled through the culvert floor bottom and grout or other hard curing material is pumped into the subsurface void for stabilization of the box culvert structure.

11 Claims, 3 Drawing Sheets

PORTABLE COFFERDAM AND METHOD FOR STABILIZING THE STRUCTURAL INTEGRITY OF BOX CULVERT BRIDGES

This application claims the benefit of U.S. Provisional Application No. 60/269,090 pursuant to 35 U.S.C. 119(e), filed Feb. 15, 2001, which is hereby incorporated by reference.

BACKGROUND OF THE INVENTION

1. Field of the Invention

The present invention relates to a device and method for stabilizing the structural integrity of box culvert bridges and similar structures and a portable cofferdam device specifically designed for such purpose.

2. Description of the Related Art

Cofferdams have long been used in the construction field as an effective means of accessing submerged areas. Cofferdams may be used to construct piers and bridge supports in lakes and rivers. Small streams or low flow rivers may be dammed on the upstream side or both upstream and downstream sides of a bridge to conduct necessary repairs or new construction.

Box culvert bridges have long been a popular bridge style in the transportation construction arena due to low cost construction and installation. The typical box culvert bridge is constructed with large multiple concrete tubes or "box culverts" connected in parallel. The length of the box culverts equals the width of the bridge road surface above. These concrete box culverts allow water flow under the bridge road surface by passing through the culvert. A typical box culvert will have two side walls rising perpendicular from the ground surface and a concrete ceiling (supporting the bridge road above the culverts), and a concrete bottom or floor which rests on the river or stream bottom. Since the typical box culvert bridge design does not require subsurface pier support or piling support, the stability of the riverbed immediately below the culvert bottom is crucial for maintaining the long term structural integrity of box culvert bridges.

Although box culvert bridges are cost effective with regard to construction and installation, riverbed scouring beneath the box culvert bottom can make long term maintenance of such bridges problematic. Specifically, natural changes in hydrologic flow conditions and extra ordinary weather events will destabilize portions of the river bottom and sides adjacent to the culvert bridge jeopardizing the structural integrity of the structure. The typical remedy employed by transportation officials for restoring the subsurface integrity of compromised box culvert bridges is to dam the upstream portion (and, if necessary, the downstream portion) of the river or stream for a period of days or weeks until a work area around the scoured area of the riverbed can be isolated and workers can pump grout or a similar hard curing material under the bridge into the water filled void created by the aforementioned scouring action. The grout or similar hard curing material is typically pumped into the water filled void through a drill hole made into the culvert bottom just above the void.

In recent years, the Federal Highway Administration has adopted more rigorous methods of inspection of such culvert bridges by employing the use of regularly scheduled underwater inspections conducted by experienced scuba divers. These divers can inspect areas under a culvert bridge that have been problematic to inspect in the past. The resulting increased number of inspections has resulted in a larger than expected number of culvert bridge repair needs. Accordingly, the traditional repair methods employed by state and regional transportation departments has failed to effectively address the number of required repairs. The present invention and associated method result in an equally effective but inexpensive means of restoring the structural integrity of culvert box bridges. The present invention does not require the complete damming of a river or stream, saving time, materials and minimizing disturbance to the environment. By employing the use of a portable coffer dam, the subsurface of a culvert bridge can be repaired quickly and cheaply, while also extending the life of the bridge.

SUMMARY OF THE INVENTION

It is therefore an objective of this invention to provide a cost effective and efficient method for repairing riverbed scouring below culvert box bridges.

It is further an objective of this invention to provide a facile device of novel design and construction to be used in the subsurface stabilization of culvert box bridges.

It is still further an objective of this invention to provide a environmentally responsible and less intrusive means for improving the long-term maintenance of box culvert bridges and similar bridge designs.

These as well as other objectives are accomplished by a chamber structure small enough to fit inside the culvert of a box culvert bridge, but large enough to house one or more persons and equipment necessary to dewater the chamber structure and pump grout or similar hard curing material through a drill hole in the culvert bottom.

The present invention is employed after identifying riverbed scouring that has occurred beneath the floor bottom of the box culvert bridge. The components of the present invention can be sufficiently compact to be transported in a medium size truck bed to the bridge location. The various components of the device include the aforementioned open chamber structure equipped with an upper expansion device, fluid discharge conduit, quick release hose and pipe connectors, a discharge pump and associated hose conduit. After arriving at the location of the box culvert bridge where the riverbed below the culvert bottom requires subsurface stabilization due to hydrologic scouring, the open chamber is slowly lowered into the river or stream along side the bridge. The water level in the river or creek must not exceed the height of the top portion of the portable cofferdam, as it could not be dewatered. After positioning the open chamber in place and securing the open chamber in place, the upper expansion device is employed to compress the chamber floor seal against the culvert bottom. Afterwards the pump intake conduit can be connected to the chamber intake conduit, and the open chamber is dewatered. The planned bridge repair is conducted by drilling a hole through the culvert bottom within the open chamber above the scour void. Grout or a similar hard curing material is pumped through the drill hole until the scour void is adequately filled. After completing the repair, the chamber upper expansion device can be released or loosened to allow the retrieval of the open chamber from the culvert.

Other aspects, features and other embodiments of the invention will be more fully apparent from the ensuing disclosure.

DETAILED DESCRIPTION OF THE INVENTION, AND PREFERRED EMBODIMENTS THEREOF

The preferred embodiment of the present invention presents an elegant device and method for reinforcing the structural integrity of certain river and stream bridge crossings. In particular, the present invention is particularly adaptive to a typical box culvert bridge structure and reinforcement of subsurface conditions of the stream or riverbed below the box culvert floor.

Figure 1:
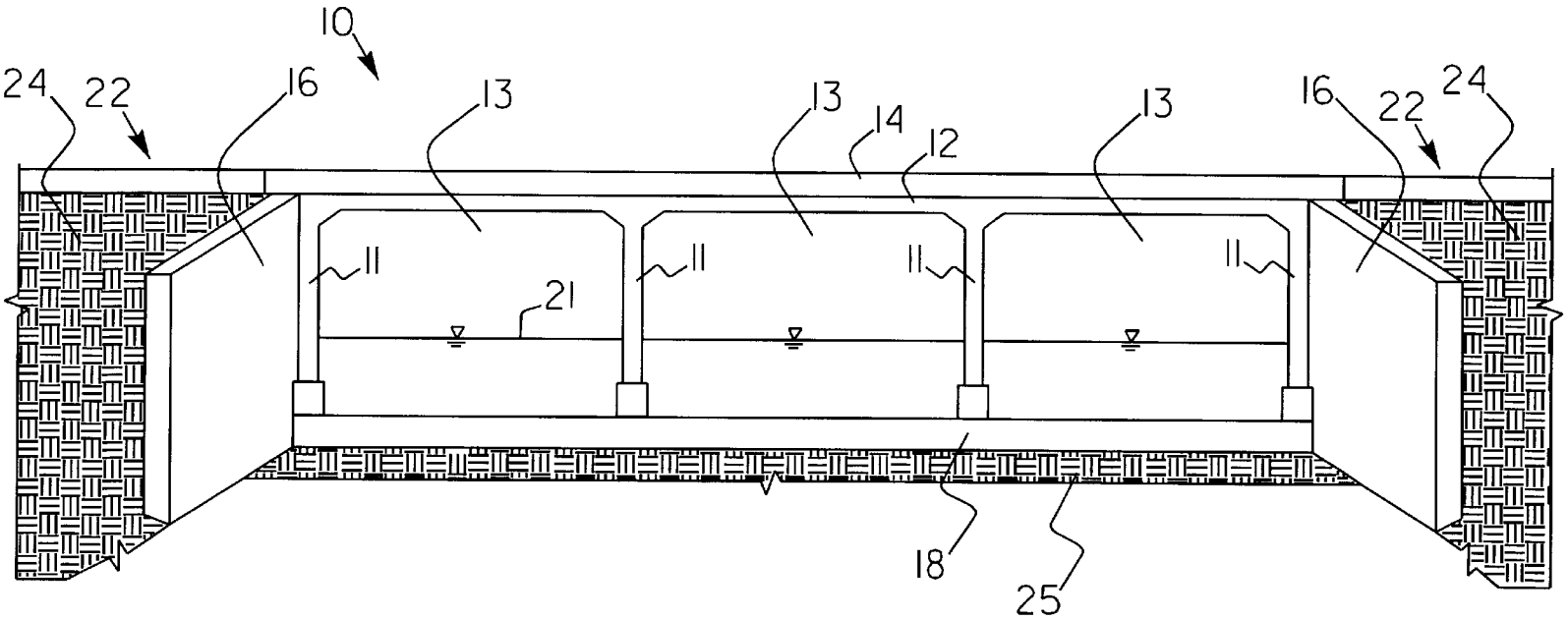
FIG. 1 is a cross-sectional view of a typical box culvert dam viewed in the direction of the water body flow.

Referring to FIG. 1, a typical box culvert bridge 10 is shown over a riverbed 25 having a river level 21. The box culvert bridge 10 comprises multiple culvert openings 13 having culvert walls 11 extending vertically from the riverbed 25 and supporting the culvert ceiling 12 and bridge roadway 14 above the culvert openings 13. The bridge roadway 14 connects to the roadway 22 at either end of box culvert bridge 10. The ends of the box culvert bridge 10 are tied into the river bank sides 24 by means of box culvert bridge tie-ins 16. Culvert floor 18 lies directly over riverbed 25.

Figure 2:
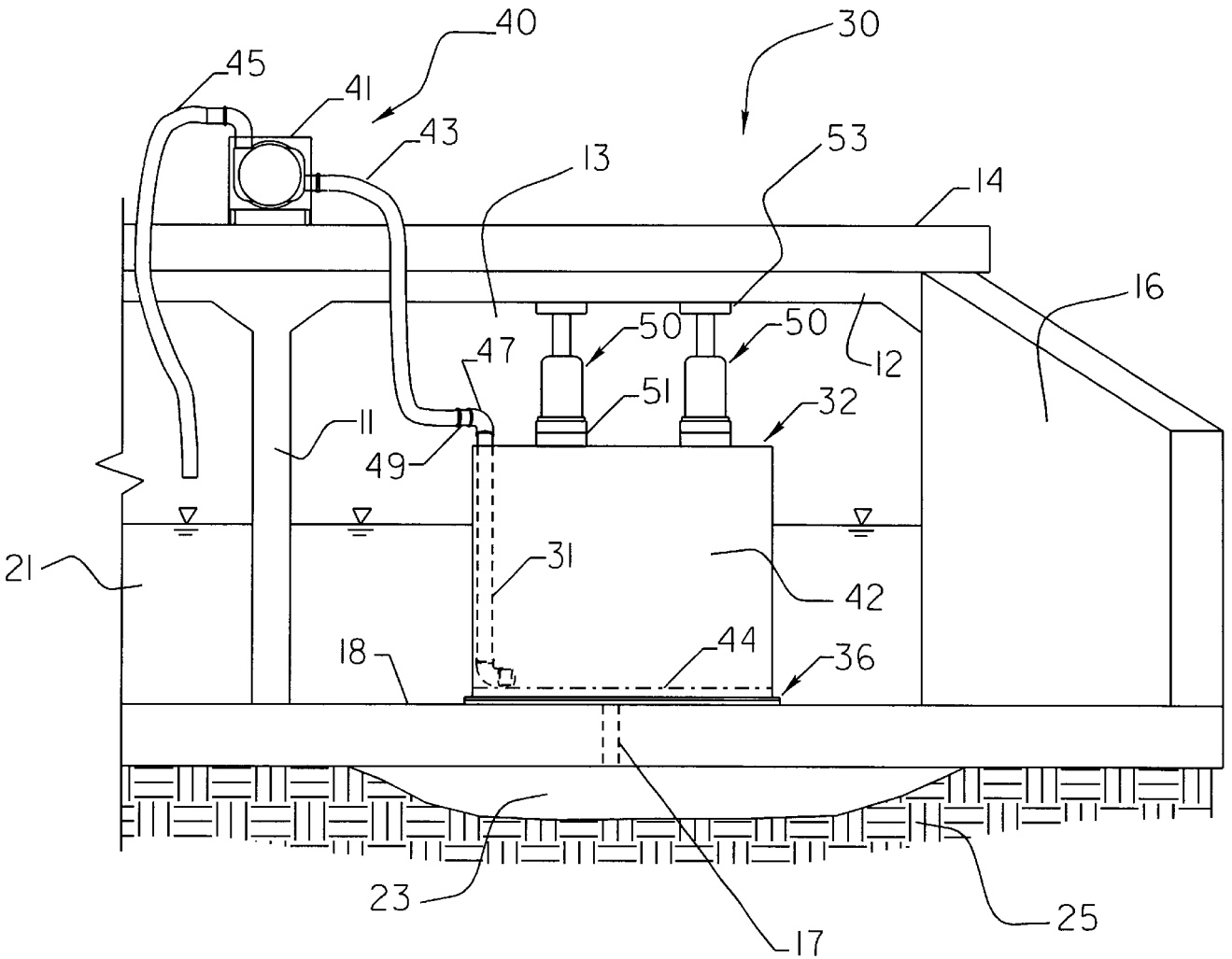
FIG. 2 is perspective view of the portable cofferdam in place inside one of a multiple culverts of box culvert bridge.

The operations of the preferred embodiment shown in FIG. 2, where the portable cofferdam 30 is in place inside a culvert opening 13 of the box culvert bridge 10 depicted in FIG. 1. Still referring to FIG. 2, chamber 32 of portable cofferdam 30 is secured over culvert floor 18 directly over a portion of scour void 23. The scour void 23 below the portion of the box culvert bridge depicted in FIG. 2 is caused by changes in hydrologic flow in and around the area of riverbed 25 under culvert floor 18. Open chamber 32 is secured in place by means of upper expansion device 50 secured to support brace 51. Expansion device 50 is used to force expansion head 53 against culvert ceiling 12, pushing chamber floor seal 36 against culvert floor 18 so that the chamber interior 42 may be dewatered via chamber intake conduit 31. Upper expansion device 50 may operate by any expansion means including hydraulic or mechanical means. The preferred embodiment uses a hydraulic jack, which can be quick released as necessary. The upper expansion device 50 is secured to open chamber 32 by means of support brace 51 that may bridge across the top opening of open chamber 32 as necessary to stabilize and level chamber floor seal 36 against culvert floor 18.

Once in place, chamber interior 42 is dewatered by employing the use of dewatering system 40 including discharge pump 41, which may rest on a stable surface such as bridge roadway 14. Pump intake conduit 43 is connected to quick release connector 49 attached to chamber discharge pipe 47 and chamber intake conduit 31. Water from inside chamber interior 42 is discharged by pump 41 through pump discharge conduit 45 into the adjacent body water. After chamber interior 42 has been sufficiently dewatered to an acceptable chamber water level 44, drill hole 17 is made by drilled through culvert floor 18. Drill hole 17 opens into scour void 23. Grout or similar hard curing material is then pumped through drill hole 17 until scour void 23 is filled and displaced stabilizing riverbed 25 and the structural integrity of the box culvert bridge.

Figure 3:
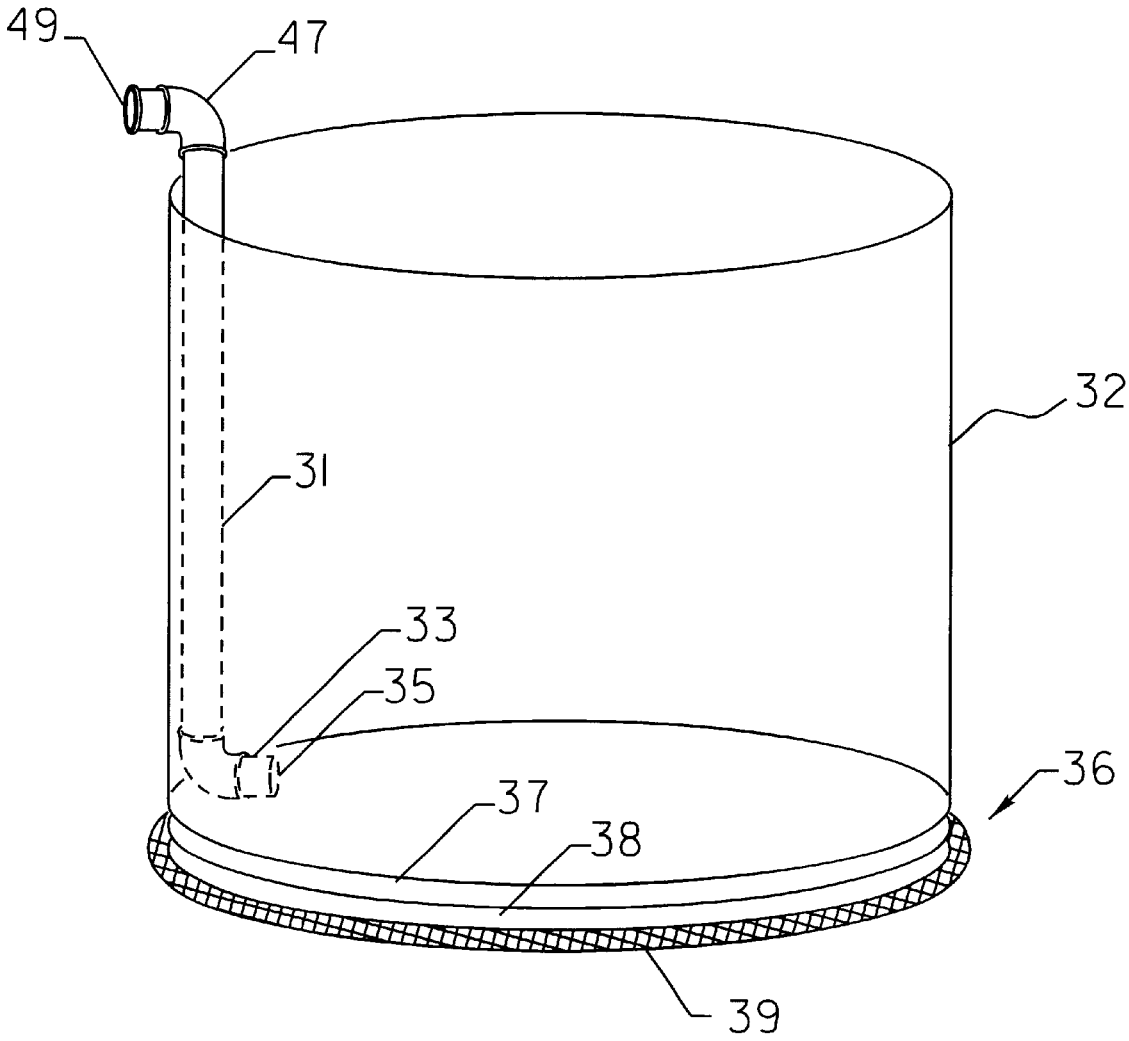
FIG. 3 is a perspective view of the open chamber portion of the portable cofferdam.

Now referring to FIG. 3, a detail of open chamber 32 is shown. The construction material of open chamber 32 is preferably steel with protective coating; however any number of materials may be found to be suitable so long as they are durable and rigid in nature. Chamber floor seal 36 comprises a rubberized lip 39 which is secured to chamber bottom 37 by means of an adhesive layer 38. The preferred adhesive layer 38 may be made of silicone rubber or other water proof adhesive sufficiently strong to secure and seal rubberized lip 39 to the culvert floor 18 with compressive forces applied by upper expansion device 50 as depicted in FIG. 2. Still referring to FIG. 3, chamber intake conduit 31 is preferably secured to the inner all of open chamber 32 and existing chamber interior 42 via chamber top 33. Quick release connector 49 allows facile hook up of pump intake conduit 43 as depicted in FIG. 2. FIG. 3 also shows chamber intake pipe equipped with an intake filter 35 or screen for removing debris from the discharge water conduits.

A preferred embodiment of the present invention is described herein. It is to be understood, of course, that changes and modifications may be made in the embodiment without departing from the scope and spirit of the present invention as defined by the appended claims.

What is claimed is:

1. A portable cofferdam for stabilizing the subsurface below a box culvert used for water crossings, comprising:

an open chamber haying an open chamber top and an open chamber bottom having a floor seal secured around the perimeter of said open chamber bottom;

an expansion device secured to said chamber top by a support brace for compressing said chamber bottom against the box culvert floor by applying expansion forces between said open chamber and the box culvert ceiling;

a means for dewatering the inside area of said open chamber;

a hard curing material inserted into the subsurface below the box culvert floor; and a means for inserting said hard curing material through the box culvert floor from said open chamber bottom into the subsurface below the box culvert floor.

2. A method for stabilizing the subsurface below a box culvert floor comprising in combination:

positioning a portable cofferdam inside a box culvert opening, said cofferdam comprising an open chamber having an open chamber top and an open chamber bottom, said open chamber bottom having a floor seal secured around the perimeter of said open chamber bottom;

compressing said floor seal of said chamber bottom against the box culvert floor by applying expansion forces between said open chamber and the box culvert ceiling;

dewatering said chamber using a chamber intake conduit inserted inside said open chamber connected to a discharge pump through a pump intake conduit;

penetrating through the box culvert floor using a hard surface penetrable drill forming a fluid conduit between said chamber bottom and the subsurface below the box culvert floor; and pumping a grout material through said fluid conduit of the box culvert floor into the subsurface below the box culvert floor.

3. A portable cofferdam according to claim 1, wherein said expansion device comprises a mechanical hydraulic jack having an expansion head extended upward against the box culvert ceiling compressing said chamber floor seal against the box culvert floor.

4. A portable cofferdam according to claim 1, wherein said means for inserting said hard curing material into the subsurface below the box culvert floor comprises:

a means for penetrating through the box culvert floor from said open chamber bottom, creating a fluid conduit between said chamber bottom and the subsurface below the box culvert floor; and a means for inserting said hard curing material through said fluid conduit of the box culvert floor into the subsurface area below the box culvert floor.

5. A portable cofferdam according to claim 3, wherein said means for penetrating through the box culvert floor comprises a hard surface penetrable drill.

6. A portable cofferdam according to claim 3, wherein said means for inserting said hard curing material through said fluid conduit of the box culvert floor comprises a pump.

7. A portable cofferdam according to claim 3, wherein said hard curing material is comprised of a grout material.

8. A portable cofferdam according to claim 1, wherein said means for dewatering the inside area of said open chamber comprises a dewatering system having a chamber intake conduit inserted into said open chamber connected to a discharge pump through a pump intake conduit.

9. A portable cofferdam according to claim 1, wherein said open chamber comprises an open cylinder comprised of a hard, rigid material.

10. A portable cofferdam for stabilizing the subsurface below a box culvert used for water crossings, comprising:

an open chamber having a cylindrical shape with an open chamber top and an open chamber bottom having a floor seal secured around the perimeter of said open chamber bottom;

an expansion device secured to said chamber top by a support brace comprising a mechanical hydraulic jack having an expansion head applying expansion forces between said open chamber and the box culvert ceiling, compressing said chamber floor seal against the box culvert floor;

a dewatering system having a chamber intake conduit inserted inside said open chamber connected to a discharge pump through a pump intake conduit for dewatering the inside area of said open chamber;

a hard surface penetrable drill for penetrating through the box culvert floor, creating a fluid conduit between said chamber bottom and the subsurface below the box culvert floor;

a grout material inserted into the subsurface below the box culvert floor; and a grout pump for insertion of said grout material through said fluid conduit of the box culvert floor into the subsurface below the box culvert floor.

11. A method according to claim 10, wherein said compressing said floor seal of said chamber bottom against the box culvert floor comprises a mechanical hydraulic jack having an expansion head extended upward against the box culvert ceiling.

* * * * *